United States Patent [19]

Eising

[11] 4,059,386

[45] Nov. 22, 1977

[54] COMBUSTION HEATING APPARATUS TO IMPROVE OPERATION OF GAS PILOT BURNERS

[75] Inventor: John P. Eising, Oconomowoc, Wis.

[73] Assignee: A. O. Smith Corporation, Milwaukee, Wis.

[21] Appl. No.: 651,217

[22] Filed: Jan. 21, 1976

[51] Int. Cl.[2] ..... F23Q 9/14

[52] U.S. Cl. ..... 431/43; 431/59; 431/62

[58] Field of Search ..... 431/43, 59, 66, 62

[56] References Cited

U.S. PATENT DOCUMENTS

| | | | |
|---|---|---|---|
| 2,216,534 | 10/1940 | Kirk | 431/43 X |
| 2,432,942 | 12/1947 | See et al. | 431/66 X |
| 3,093,185 | 6/1963 | Lowry | 431/59 X |
| 3,240,257 | 3/1966 | Ray | 431/43 |

FOREIGN PATENT DOCUMENTS

| | | | |
|---|---|---|---|
| 819,256 | 9/1959 | United Kingdom | 431/43 |

*Primary Examiner*—Carlton R. Croyle
*Assistant Examiner*—Leonard Smith
*Attorney, Agent, or Firm*—Andrus, Sceales, Starke & Sawall

[57] ABSTRACT

A gas pilot burner arrangement in which only air from the blower discharge plenum connected to the main gas burner is initially supplied to the pilot burner to mix with gas being supplied to the pilot burner through the pilot gas conduit and when a flame sensor is activated to prove that the pilot is lit a valve is electrically activated to flow gas to the main burner and simultaneously provide a premix of raw gas and air to the pilot burner in addition to the gas admitted to the pilot through the pilot gas conduit.

1 Claim, 1 Drawing Figure

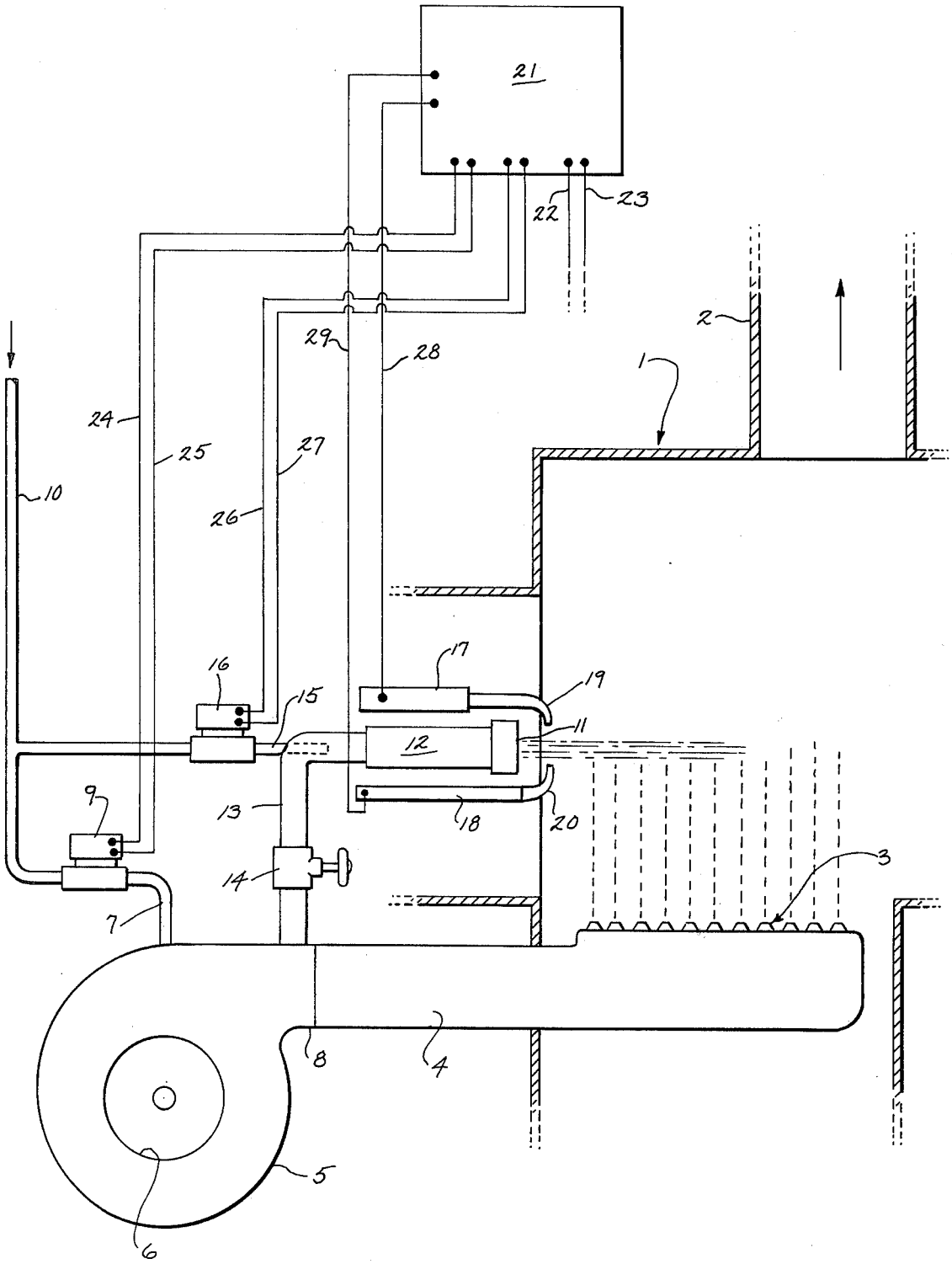
21
22
23
2
1
29
28
24
25
27
10
26
16
15
17
19
11
12
9
13
18
20
14
3
7
8
4
5
6

COMBUSTION HEATING APPARATUS TO IMPROVE OPERATION OF GAS PILOT BURNERS

BACKGROUND OF THE INVENTION

A premix burner operating in a pressurized combustion chamber presents some unusual pilot and ignition problems. The use of an atmospheric naturally aspirated pilot burner is not satisfactory because the intermittently pressurized combustion chamber produces unstable pilot burner operation. The source of air for a pressure pilot is also limited. When the main gas is fed into the inlet of the combustion air blower there is no continuous source of air which can be used in an air gas mixer for the pilot burner. The present invention overcomes the problem by a take-of connection from the blower discharge plenum to the pilot burner air gas mixer chamber so that when the blower is operating initially only combustion air is supplied through the connection to the pilot mixture and when the main valve opens a mixture of air and gas is supplied under pressure to the pilot burner from the blower and in addition gas is supplied to the pilot burner from the pilot burner gas source.

SUMMARY OF THE INVENTION

In carrying out the invention in order to provide the pilot burner with a pressurized source of air, a take-off piping connection is connected at one end to the blower plenum discharge and at the other end to the mixer chamber of the pilot valve. Control of the flow of air and air and gas from the blower plenum discharge chamber is maintained by an adjustable valve located in the take-off connection. Upon the start of the blower, the air gas mixture in the pilot mixer chamber is lean because the blower plenum only supplies air. However, as soon as the pilot burner is ignited electronically and the flame electronically proven, the main gas valve opens and supplies a mixture of gas and air to the pilot mixing chamber. This provides a rich mixture to the pilot burner because in addition to the gas admitted through the pilot gas valve the combustion air from the blower is also a combustible air-gas mixture.

DESCRIPTION OF THE DRAWING

The single FIGURE of the drawing is a schematic representation of the combustion chamber of a gas burner together with the arrangement for supplying air and gas to the main burner and the pilot burner.

DESCRIPTON OF THE PREFERRED EMBODIMENT

Referring to the drawing, there is shown a portion of a combustion chamber 1 from which upwardly extends the flue 2 and within the lower portion of which is located the gas burner 3. Premixed air and gas are supplied to burner 3 through tube 4 and the entry end of the tube is connected to the blower 5 which has a central air inlet opening 6. Gas is supplied to the blower 5 through the gas connection 7 so that when blower 5 is operating a combustible air and gas mixture is pumped by blower 5 to the blower discharge plenum chamber 8 and thence through tube 4 to gas burner 3.

The connection 7 is connected to blower 5 through the solenoid operated valve 9 and then by the gas supply piping 10 to a source of gas, not shown.

The apparatus of the system also includes a pilot burner 11 which is disposed to ignite the main burner 3. The pilot 11 is connected to the mixer chamber 12 which in turn is joined by a piping connection 13 to the blower discharge plenum chamber 8. A valve 14 is disposed within piping connection 13 and is manually adjustable to control the flow of air or air and gas through connection 13 to the pilot mixer chamber 12.

Gas is supplied to the pilot mixer chamber 12 through piping 15 which is connected to the pilot mixer chamber 12 at one end and to the gas supply piping 10 at the other end. Control of the supply of gas to the pilot mixer chamber 12 is obtained by the solenoid operated valve 16 located within the pilot gas supply pipe 15.

The pilot burner 11 is encompassed by an electronically actuated spark igniter 17 to ignite the pilot and an electronically actuated flame sensor 18 to sense whether the pilot burner has been ignited. Spark igniter 17 has a forward projecting small electrode 19 inwardly curved to the forward end of the pilot burner 11 and the flame sensor 18 has a similar electrode projection 20 inwardly curved toward the forward end of pilot burner 11.

The operation of the respective burners, blowers, flame sensor and igniter is accomplished electronically through the control panel 21 which for the purposes of the invention need only be generally described. Control panel 21 is connected to a source of electric power, not shown, by lines 22 and 23.

Control panel 21 is connected to solenoid valve 9 by lines 24 and 25 and the latter is actuated to open or close the gas supply pipe 10 to control the supply of gas to blower 5. Control panel 21 is also connected by lines 26 and 27 to the pilot solenoid valve 16 to open or close pipe 15 to control the supply of gas to the pilot burner 11. In addition line 28 connects the spark igniter unit 17 to control panel 21 and line 29 connects the flame sensor 18 to control panel 21.

In the operation of the apparatus, when heat is called for, a thermostat, not shown, starts blower 5 and simultaneously a spark is established by igniter 17 and the pilot solenoid valve 16 opens the pilot supply pipe 15 to supply gas to the pilot mixing chamber 12 and thence to pilot 11. After the pilot burner 11 is sparked by igniter 17, the flame sensor 18 is actuated to prove that pilot 11 is lite. During this period of time blower 5 is supplying combustion air to the pilot mixing chamber 12 through the take-off piping connection 13 connected to chamber 12 at one end and to the blower plenum chamber 8 at the other end. Previously the valve 14 in piping 13 has been manually opened to a predetermined position to control the flow of the combustion air supply.

If flame sensor 18 proves that pilot 11 has been ignited, the main gas solenoid valve 9 opens and gas is conveyed by blower 5 through tube 4 to main gas burner 3 which is ignited by pilot burner 11. At this time the blower provides a premix of raw gas and air to the pilot mixing chamber 12 through take-of connection 13 and thence to pilot burner 11. This is in addition to the gas admitted to pilot 11 through the pilot gas piping 15.

The ratio of the flame of the main gas burner to the pilot flame is about 750 to 1 and the richer pilot flame is not discernable or objectionable. The pilot burner which is fully pressurized by use of the take-off connection 13 to the blower is not adversely affected by varying pressures in combustion chamber 1 of the main burner.

Various modes of carrying out the invention are contemplated as being within the scope of the following claims particularly pointing out and distinctly claiming the subject matter which is regarded as the invention.

I claim:

1. Combustion heating apparatus to improve operation of a gas pilot burner by providing a construction to supply a pressurized air-gas combustion mixture, a main gas burner and a pilot burner, a spark igniter and a flame sensor assembled with the pilot burner, a first conduit connected to the source of gas and to the pilot burner to supply gas to the pilot burner, a first solenoid valve disposed in the first conduit to control the flow of gas through the first conduit to the pilot burner, a second conduit connecting the source of gas to the main gas burner, a blower connected to the second conduit and adapted to force premixed air and gas to the main burner through the second conduit, a plenum chamber disposed on the discharge side of the blower, a mixing chamber provided at the rear portion of the pilot burner, a third conduit extending between the mixing chamber of the pilot burner and the plenum discharge chamber of the blower, electrical control means activated when heat is called for to start the blower and initially supply air to the pilot burner through the third conduit and simultaneously establish a spark by the igniter to open the first solenoid valve to also supply gas to the pilot burner through the first conduit to light said pilot, and a second solenoid valve located to control the flow of gas through the second conduit with air from the blower to the main burner and opened to initiate such gas flow when the sensor proves the pilot burner is lit and to then supply a mixture of gas and air through the third conduit to the pilot burner in addition to the gas supplied to the pilot burner through the first conduit to thereby provide a richer pilot flame which is not adversely affected by varying pressures in the main gas burner combustion chamber.

* * * * *